US008827672B2

(12) United States Patent
Wu et al.

(10) Patent No.: US 8,827,672 B2
(45) Date of Patent: Sep. 9, 2014

(54) ELECTROSPINNING DEVICE FOR FABRICATING MEMBRANE BY USING SPINNERETS ALIGNED IN MACHINE DIRECTION AND TRANSVERSE DIRECTION AND METHOD FOR USING THE SAME

(75) Inventors: Dayong Wu, Haidian District Beijing (CN); Haiyan Wang, Haidian District Beijing (CN); Jianhua Cao, Haidian District Beijing (CN)

(73) Assignee: SKPB Membrane-Tech (Beijing) Corporation, Beijing (CN)

( * ) Notice: Subject to any disclaimer, the term of this patent is extended or adjusted under 35 U.S.C. 154(b) by 225 days.

(21) Appl. No.: 13/379,641

(22) PCT Filed: Jun. 23, 2010

(86) PCT No.: PCT/CN2010/000922

§ 371 (c)(1),
(2), (4) Date: Dec. 20, 2011

(87) PCT Pub. No.: WO2010/148644

PCT Pub. Date: Dec. 29, 2010

(65) Prior Publication Data

US 2012/0112389 A1 May 10, 2012

(30) Foreign Application Priority Data

Jun. 24, 2009 (CN) ..... 2009 1 0087706

(51) Int. Cl.
*D01D 5/00* (2006.01)

(52) U.S. Cl.
USPC ..... 425/81.1; 364/441; 364/465; 425/83.1; 425/174.8 E

(58) Field of Classification Search
USPC ..... 425/81.1, 83.1, 174.8 E; 264/441, 465, 264/466, 467
See application file for complete search history.

(56) References Cited

U.S. PATENT DOCUMENTS

| | | | | |
|---|---|---|---|---|
| 4,689,186 | A * | 8/1987 | Bornat | 264/6 |
| 6,053,719 | A * | 4/2000 | Barbier et al. | 425/81.1 |
| 6,989,125 | B2 * | 1/2006 | Boney et al. | 264/465 |
| 2002/0117770 | A1 * | 8/2002 | Haynes et al. | 264/103 |

FOREIGN PATENT DOCUMENTS

| | | |
|---|---|---|
| CN | 1664182 | 9/2005 |
| CN | 101192681 | 6/2008 |
| CN | 101280469 | 10/2008 |
| CN | 201148479 | 11/2008 |
| KR | 100857193 | 9/2008 |

* cited by examiner

*Primary Examiner* — Yogendra Gupta
*Assistant Examiner* — Joseph Leyson
(74) *Attorney, Agent, or Firm* — Rankin, Hill & Clark LLP

(57) ABSTRACT

The present invention relates to an electrospinning device for fabricating a membrane, in particular, to an electrospinning device for fabricating membrane by using spinnerets aligned in machine direction (MD) and transverse direction (TD) in a high-voltage DC electric field, and to method for using the same. In addition to producing a single-layer nanofiber membrane from a polymer composite, the electrospinning device according to the present invention can also conveniently produce a multilayer composite nanofiber membrane from more than one polymer composites. The electrospinning device comprises a control section, an electrospinning section and an ancillary section. The electrospinning section comprises a MD spinnerets set and a TD spinnerets set that are alternately arranged and moves above a membrane collecting device in a to-and-fro scanning manner so as to improve the evenness and strength of the obtained membrane. The high-voltage DC electric field is applied between the MD and TD spinnerets sets and a stainless steel conveyer belt for collecting the membrane. A polymer solution supplied to the MD and TD spinnerets sets is split into nanoflows under the action of the electric field, accumulated on the stainless steel conveyer belt to form a membrane and carried to a collecting roller to be collected.

15 Claims, 2 Drawing Sheets

ELECTROSPINNING DEVICE FOR FABRICATING MEMBRANE BY USING SPINNERETS ALIGNED IN MACHINE DIRECTION AND TRANSVERSE DIRECTION AND METHOD FOR USING THE SAME

TECHNICAL FIELD

The present invention relates to an electrospinning device for fabricating a membrane, in particular, to an electrospinning device for fabricating membrane by using spinnerets aligned in both machine direction (MD) and transverse direction (TD) in a high-voltage DC electric field, and to method for using the same.

BACKGROUND ART

Electrospinning is an important method for the production of nanofibers and functional nanofibre membranes. Because the key of electrospinning is the production of nanoflows and nanofibers, the production efficiency of a single spinneret is rather low. Currently, the electrospinning is attracting increasing interests. However, most of the related researches are fundamental and use simple devices with a single spinneret and a metal plate (or roller) as receiving electrode to produce various kinds of nanowires or nano-composite materials. Nevertheless, a promising electrospinning technique in the future must be devices with multiple spinnerets. Due to the high voltage up to thousands of volts applied on a spinneret during electrospinning, the jetted nanoflows are charged and repulse each other, which causes the unevenness of the obtained membrane. In addition, since the nanoflows repulse each other, the volume of solution jetted from one of the multiple spinnerets may be smaller than that from the single spinneret.

In order to overcome the adverse influence resulted from the interference of the nanoflows from multiple spinnerets and to increase the throughput, O. Jirsak et al from Liberec Technology University, Czechoslovakia, completely abandoned the conventional spinneret and adopted a solution supplying method of roller dipping in solution, adapting the roller in various ways to make it easy for electrospinning. The technique of O. Jirsak et al has patent applications in many counties including a Chinese application No. 200480025691.5. The corresponding device is popularly called "nano-araneid".

The "nano-araneid" is a breakthrough and innovation of electrospinning principle. However, by analyzing the principle of the "nano-araneid", the inventors find that problems as follows exist: discontinuousness of solution supplying results in discontinuousness and unevenness of nanofibers; and fibers transferring with help of flowing air results in weak strength, of the membrane. The later problem can not be solved easily without a follow-up cross-linking treatment. In additional, with the "nano-araneid", the width of a membrane is determined by the width of the roller dipping in solution, and cannot be set freely without cutting.

Another effort to increase the production efficiency of electrospinning is to design an electrospinning device with multiple spinnerets. For example, when multiple spinnerets are integrated with different geometric arrangements and jet in a to-and-fro scanning manner, the production efficiency can be increased to, some extent and the evenness of the obtained membranes will be improved, see for example CN200610144191.4. However, the device involved in this invention doesn't have the capacity of continuous production and should be further developed.

"Nano-araneid" is suitable for producing a nanofiber rather than a nanofiber membrane. Other conventional electrospinning devices can be used to produce a single-layer membrane, but are not convenient for the preparation of a multilayer composite membrane.

SUMMARY OF THE INVENTION

An object of the invention is to provide an efficient electrospinning device for fabricating a nanofiber membrane from a polymer composite in a high-voltage DC electric field. The electrospinning device comprises a linear array of a plurality of sets of spinnerets aligned in MD or TD for continuous and precise supply of raw materials. The device can produce a single-layer nanofiber membrane from a polymer composite and produce a multilayer composite nanofiber membrane from more than one polymer composites. Another object of the invention is to provide a method for using the electrospinning device for fabricating a membrane.

By systematic integrating the functions of membrane forming, in situ detection, molding, product collection and controlling, the present invention provides a new efficient multifunctional electrospinning device for fabricating nanofiber membrane. In order to solve the problems of low efficiency of the spinneret and unevenness of the nanofiber membrane in conventional multi-spinnerets electrospinning technique, a set of spinnerets aligned in MD (for simplicity, referred to as MD spinnerets set hereinafter) and a set of spinnerets aligned in TD (for simplicity, referred to as TD spinnerets set hereinafter) are alternately arranged along the MD of the electrospinning device for fabricating a nanofiber membrane. Such an arrangement of the MD spinnerets set and TD spinnerets set also increases the mechanical strength of the obtained membrane. Furthermore, the spinnerets in each of the MD spinnerets set and TD spinnerets set are aligned in a line with the distances between neighbor ones being non-uniform and the flow rate of a solution fed into each spinneret in both the MD spinnerets set and the TD spinnerets set can be finely adjusted independently, so as to balance the repulsing between charged solution flows from the spinnerets, increase the jetting efficiency of the MD spinnerets set and TD spinnerets set and further improve the evenness of the obtained membrane.

In addition to producing a single-layer nanofiber membrane from a polymer composite, the electrospinning device according to the present invention can also conveniently produce a multilayer composite nanofiber membrane from more than one polymer composites. The electrospinning device comprises three main sections, which are a control section comprising a global control unit, a high-voltage DC power supply and at least one precision feeding pump, a section for electrospinning nanofibe membrane comprising at least a MD spinnerets set, a TD spinnerets set, linear motion guides, a first main driving roller, a second main driving roller, at least one heating support roller, a stainless steel conveyor belt and a lift platform, and an ancillary section comprising at least a thickness-control device, a molding roller, an electrostatic eliminator, a membrane collecting roller, an air compressor, temperature control devices and a ventilation device.

The present invention seeks to provide a production line of nanofiber membrane, which is embodied as an efficient electrospinning device with a linear array of a plurality of sets of spinnerets. The MD spinnerets set and TD spinnerets set are mounted above the stainless steel conveyor belt which is horizontally mounted, and the jetting direction of each spinneret is perpendicular to the stainless steel conveyor belt. The high-voltage DC power supply is connected to a metal part of each of the MD spinnerets set and TD spinnerets set via wires to provide a positive or negative high-voltage thereto, while the stainless steel conveyor belt is grounded by special wires, so as to form a high-voltage electrostatic field between the MD and TD spinnerets sets and the stainless steel conveyor belt. When the total number of the MD spinnerets set and TD spinnerets set is 16 or more and the length of the stainless steel conveyor belt is 9 meters or more, the device has a capacity of continuous membrane production. When the total number of the MD spinnerets set and TD spinnerets set is less than 16 and the length of the stainless steel conveyor belt is less than 9 meters, the device can be used to produce a discontinuous membrane, of which the maximum length is equal to the length of the stainless steel conveyor belt.

The MD spinnerets set and TD spinnerets set are formed by integrating the existing spinnerets.

The electrospinning device for fabricating membrane according to the invention comprises the control section comprising the global control unit, the high-voltage DC power supply and the precision feeding pump, the section for electrospinning nanofiber membrane comprising at least the MD spinnerets set, the TD spinnerets set, the linear motion guides, the first main driving roller, the second main driving roller, the heating support roller, the stainless steel conveyor belt, and the lift platform, and an ancillary section comprising the thickness-control device, the molding roller, the electrostatic eliminator, the membrane collecting roller, the air compressor, the temperature control devices and the ventilation device.

The first and the second main driving rollers are respectively mounted on a working platform with a spacing therebetween and the stainless steel conveyor belt is mounted on and run circularly around the first and the second main driving rollers. The stainless steel conveyor belt is grounded by specific wires. Between the first and the second main driving rollers, the heating support roller is mounted between the upper portion and the lower portion of the stainless steel conveyor belt. The global control unit, the high-voltage DC power supply and the precision feeding pump are mounted on the portion of the working platform that is outside of the space between the first and the second main driving rollers and near the first main driving roller. The membrane collecting roller is mounted on the portion of the working platform that is outside of the space between the first and the second main driving rollers and near the second main driving roller.

The lift platform is mounted above the stainless steel conveyor belt, and at least two beams are mounted on the lift platform across the width of the stainless steel conveyor belt. Each beam has a respective precision linear motion guide mounted thereon. Each precision linear motion guide is driven by a stepper motor or servo motor that is integrated with the precision linear motion guide, and comprises a slider that can move to-and-fro at a constant speed in accordance with a preset process. When there are two such beams, the MD spinnerets set is mounted on the slider on one beam, and the TD spinnerets set is mounted on the slider on the other beam. When there are more than two such beams, the MD spinnerets sets and the TD spinnerets sets are alternately mounted on the equally spaced beams.

The lift platform, the portions of the stainless steel convey belt that are below the lift platform and that are between the lift platform and the first main drive roller, and the first main drive roller itself are covered by an isolation hood. The temperature control devices are each mounted at a respective one of four upper corners of the isolation hood, and the ventilation device is mounted on the top of the isolation hood. Outside the isolation hood, in the direction from the lift platform to the second main driving roller, the thickness-control device, the molding roller and the electrostatic eliminator are mounted in this order above the portion of the stainless steel conveyer belt between the lift platform and the second main drive roller and spaced apart.

The first and the second main driving rollers, the molding roller and the membrane collecting roller are each connected to its respective driving motor of which the rotations are synchronized.

The first main driving roller is equipped with a position adjusting cylinder and/or the second main driving roller is equipped with a position adjusting cylinder, the molding roller is equipped with a pressure adjusting cylinder, and all of the cylinders are connected to the air compressor through pipes.

The precision feeding pump, a control motor of the lift platform, the stepper motor or servo motor driven the MD spinnerets set, the stepper motor or servo motor driven the TD spinnerets set, a heating device of the heating support roller, a control circuit of the thickness-control device, a driving motor of the molding roller, a driving motor of the membrane collecting roller, a switch circuit of the electrostatic eliminator, a switch circuit of the air compressor, a control circuit of the temperature control device and a switch circuit of the ventilation device are all connected to a control circuit of the global control unit.

The precision feeding pump is connected to the MD and TD spinnerets sets respectively through pipes.

The high-voltage DC power supply provide a positive or negative high-voltage to a metal part of each of the MD and TD spinnerets sets via wires, and the stainless steel conveyor belt is grounded via specific wires.

The lift platform is equipped with a height-adjustable vertical positioning system such as height-adjustable columns, and the height of the lift platform can be adjusted by a motor connected to the vertical positioning system.

The distance between a beam on which the MD spinnerets set is mounted and a neighbor beam on which the TD spinnerets set is mounted is about 60 cm.

When the at least one heating support roller comprises more than one heating support rollers, the distance between adjacent heating support rollers is about 60 cm.

Each of the MD and TD spinnerets sets consists of an array of a plurality of spinnerets. The distance between two neighbor spinnerets is in the range of 18-60 mm, and the number of the spinnerets in each of the MD and TD spinnerets sets is preferably in the range of 8-20. The distances between neighbor spinnerets in each of the MD and TD spinnerets sets are non-uniform. The diameter of the pinhole of a single spinneret is in the range of 0.8-1.6 mm, and the length of a spinneret is in the range of 10-30 mm. The MD and TD spinnerets sets are both fixed to the sliders of the precision linear motion guide and driven by the stepper motors or servo motors to move in a to-and-fro scanning manner transverse to the moving direction of the stainless steel conveyor belt. The scanning speed of the MD spinnerets set is in the range of 90-360 cm/min, and that of TD spinnerets set is in the range of 30-120 cm/min. The scanning amplitude of the MD spinnerets set that is also the width of the obtained membrane, is in the range of 600-1000 mm.

The global control unit can be the control circuit of the whole device and can be used to set such operation parameters as the speed of the conveyor belt, the height the of lift platform, the scanning speed of the MD and TD spinnerets sets, the temperature of the electrospinning region and the molding temperature. The high-voltage DC power supply is provided for the MD and TD spinnerets sets. The number of the outputs from high-voltage DC power supply is same as the number of the MD and TD spinnerets sets. The positive or negative high-voltage generated by the high-voltage DC power supply is directly led to the metal part of each of the MD and TD spinnerets set via wires. The precision feeding pump is used to accurately inject a predetermined amount of a polymer solution for forming the polymer nanofiber membrane to the MD and TD spinnerets sets through soft pipes. The air compressor can produce adequate pressed air to supply to the cylinders for the first main driving roller, the second main driving roller and the molding roller, which can be displaced under the driving of the cylinders to adjust the tension of the stainless steel conveyor belt and the pressure applied by the molding roller.

The stainless steel conveyor belt is driven by the first main driving roller or the second main driving roller to pass through the lift platform, and at the same time a polymer nanofiber membrane is electrospinned on the stainless steel conveyor belt. The polymer nanofiber membrane is then carried by the stainless steel conveyor belt to the thickness-control device where the thickness of the membrane is measured. When the thickness does not meet a preset value, the stainless steel conveyor belt continues running circularly to continue the electrospinning process. When the thickness meets the preset value, the polymer nanofiber membrane is carried to the molding roller for molding process, to the electrostatic eliminator for electrostatic eliminating, and to the membrane collecting roller where the polymer nanofiber membrane is cut and then collected.

The lift platform is isolated. The electrospinning region is defined to enclose the lift platform, the MD and TD spinnerets sets and the region below the lift platform. The temperature of the electrospinning region can be adjusted by the temperature control devices, and the temperature of stainless steel conveyor belt can be further adjusted by the heating support roller. The height of lift platform can be adjusted by the motor connected to the vertical positioning system.

The MD and TD spinnerets sets are alternately mounted on the lift platform with a uniform spacing. Preferably, the number of the MD spinnerets sets and the number of the TD spinnerets sets are both in the range of 2-8. Compared with the mounting of only TD spinnerets set, the alternate mounting of the MD and TD spinnerets sets can significantly improve the evenness of the electrospun membrane and the interweavement of the fibers, thereby increasing the mechanical strength of the membrane.

Each of the MD and TD spinnerets sets comprises a linear array of stainless steel spinnerets. In order to reduce the impact of the repulsive force between nanoflows that are jetted from different spinnerets and carry the same charges on the flow rate of the nanoflow jetted from a spinneret, the distances between neighbor spinnerets are made non-uniform and in the range of 18-60 mm. The amount of the solution fed into each spinneret can be finely adjusted by its own micro valve, As a whole, each spinnerets set is conductive and connected to the high-voltage DC power supply via specific wires. A high-voltage electrostatic field is generated between the spinnerets sets that are used as charged electrodes and a counter electrode such as the stainless steel conveyor belt grounded via specific wires.

An electrospinning solution is continuously and precisely supplied by the feeding pump to the MD and TD spinnerets sets through pipes, and then continuous jets of nanoflow are formed under the action of an electric field force and collected on the surface of stainless steel conveyor belt. When the stainless steel conveyor belt is passing through the region under each of the spinnerets sets, the nanofibers are being gradually collected and accumulated to form a membrane. Due to a number of spinnerets sets are mounted, each spinnerets set can apply an independent polymer composite to electrospinning. Therefore, the electrospinning device according to the present invention can be used to prepare a multilayer composite membrane of two or more polymer composites. The number of the at least one precision feeding pump is equal to the number of the layers of the composite membrane. One feeding pump can supply the polymer solution to all the spinnerets sets applying the same polymer composite. The amount of the polymer solution supplied to each spinnerets set is determined from the designed components of the composite membrane.

Under the action of the electric field force, the charged polymer solution can overcome the surface tension at the tip of the spinneret and is split into nanoflows, which jet onto a collecting plane to form a polymer nanofiber membrane with a high-porosity and high-strength network. The temperature of the electrospinning region is controlled to be constant and in the range of 30-60° C. by the temperature control devices.

The technological parameters of electrospinning include the output voltage of the high-voltage DC power supply, the collecting distance, the temperature, and the scanning speed of the MD and TD spinnerets sets. In the electrospinning device according to the present invention, the technological parameters mentioned above can be controlled. The ingredients of a polymer composite solution can be adjusted as required.

The electrospinning region is isolated by a glass hood in order to prevent the diffusion of solvent and improve the dustproof effect. The ventilation device is mounted at the top of the electrospinning region. In the case, of organic-solvent applied application, a solvent-recycling system could be connected to the ventilation device to meet the requirements of environmental protection.

The method for fabricating a polymer nanofiber membrane by the electrospinning device according to the present invention comprises the steps of:

(1) preparing a polymer electrospinning solution using a solvent, such as a organic solvent or water, and adjusting the viscosity of the solution to be in the range of 300-1000 mPa·S by adjusting the concentration of the polymer;

(2) setting the operation parameters of the electrospinning device according to the viscosity of the polymer solution prepared at step (1), comprising: adjusting the distance between the MD and TD spinnerets sets and the collecting plane of the stainless steel conveyor belt to be in the range of 5-15 cm, adjusting the output voltage of the high-voltage DC power supply to be in the range of 5-25 kV, driving the MD and TD spinnerets sets by their respective driving motors to move in a to-and-fro scanning manner in the direction perpendicular to the moving direction of the stainless steel conveyor belt with the scanning speeds of the MD and TD spinnerets sets being in the ranges of 90-360 cm/min and 30-120 cm/min respectively (The MD and TD spinnerets sets move transverse to the moving direction of the conveyor belt in a to-and-fro scanning manner so that each spinnerets set jets a sine wave-like trace. After a number of the to-and-fro motions of the spinnerets sets and the circling of the conveyor belt, an uniform membrane is formed), setting the moving speed of the stainless steel conveyor belt driven by the first and the second main driving rollers to be in the range of 15-240 cm/min; setting the flow rate of the polymer solution fed into each spinneret of both the MD and TD spinnerets sets from the precision feeding pump(s) to be in the range of 1-20 mL/h, heating the stainless steel conveyor belt by the heating support roller so that the temperature thereof is in the range of 30-40° C., controlling the temperature of the electrospinning region to be between 30° C. and 60° C. by the temperature control devices, setting the thickness of the polymer nanofiber membrane to be formed by the thickness control device, and setting the molding temperature by the molding roller;

(3) switching on the high-voltage DC power supply, the driving motors of the first or the second main driving roller, the stepper motors or servo motors for the precision linear motion guides that are connected to the MD and TD spinnerets sets, the precision feeding pump, and supplying the polymer electrospinning solution prepared at the step (1) to each MD or TD spinnerets set to jet in the order from the distance to the near to the collecting roller, wherein the portion of the stainless steel conveyer belt vertically below the spinnerets set furthest from the collecting roller is referred to as the initial portion of the conveyer belt, and a spinnerets set will not start to jet until the initial portion moves to the position vertically below it; and the polymer electrospinning solution is dispensed by a dispenser to each spinneret, immediately polarized at the tip thereof, split into nanoflows with a certain orientation under the strong action of the electric field between the MD and TD spinnerets sets and the conveyor belt, and a polymer nanofiber membrane with high strength and high porosity are gradually formed on the surface of the stainless steel conveyor belt as the solvent is volatilized in the course of jetting;

(4) carrying the polymer nanofiber membrane formed in the step (3) by the stainless steel conveyor belt to the thickness control device to measure the thickness thereof, keeping the stainless steel conveyor belt moving circularly and continuing the electrospinning of the polymer electrospinning solution if the thickness doesn't meet a preset value, and carrying the polymer nanofiber membrane to the molding roller for molding process, to the electrostatic eliminator for electrostatic eliminating, and to the membrane collecting roller where the polymer nanofiber membrane is separated from the stainless steel conveyor belt and then collected if the thickness meets the preset value.

When one kind of polymer solution is loaded in the precision feeding pump(s) connected to the MD and TD spinnerets sets, a single-layer polymer nanofiber membrane will be formed.

When a polymer composite nanofiber membrane is to be produced from two or more polymer composites, two or more precision feeding pumps should be used and each precision feeding pump supplies one of the solutions of the polymer composites to a respective one of the MD and TD spinnerets sets through a respective flow distributor and pipes. In other words, when solutions of two or more kinds of polymer composites are loaded in two or more precision feeding pumps connected to the MD and TD spinnerets sets, a multilayer polymer nanofiber membrane will be formed.

The polymer is selected from a group consisting of poly (vinyl pyrrolidone) (PVP), poly(ethylene glycol) (PEG), poly (vinyl alcohol) (PVA), polyacrylonitrile (PAN), poly(vinylidene fluoride) (PVDF), PVDF-hexafluoropropylene (HFP) and Nylon-6.

The organic solvent comprises at least one selected from a group consisting of ethanol, isopropanol, m-cresol, dimethylformamide, dimethylacetamide, acetone, dichloromethane and the like. For a water-soluble polymer, water can be used as the solvent.

The efficient electrospinning device for fabricating membrane in accordance with the present invention solves the problems of low efficiency and unevenness of membranes in a conventional electrospinning device with multiple spinnerets. Specifically, with the alternately arranged MD and TD spinnerets sets, the electrospinning device according to the present invention decreases the thickness difference between the center portion and the edge portions of a membrane and thus improves the evenness of the membrane. Moreover, in the electrospinning device according to the present invention, the spinnerets in each of the MD and TD spinnerets sets are aligned in a linear array, the distances between neighbor spinnerets are designed to be non-uniform, and the flow rate of the solution fed into each spinneret can be finely adjusted independently. As a result, the repulsing between the charged solution flows from the spinnerets is balanced and the efficiencies of the MD spinnerets set and TD spinnerets set are improved. In accordance with the present invention, functions of membrane forming, in situ detection, molding, product collection and control are integrated into the electrospinning device. Under the action of the electric field induced by the high-voltage applied between the MD and TD spinnerets sets and the stainless steel conveyor belt for membrane collection, the polymer solution arriving at the tips of the spinnerets is split into nanoflows and then collected and accumulated on the stainless steel conveyor belt to form a membrane, which is carried by the stainless steel conveyor belt and then collected. The electrospinning device according to the present invention can not only conveniently produce both a single-layer nannofiber membrane from a polymer composite and a multilayer composite nanofiber membrane from different polymer composites, but also further improve the mechanical strength of the formed membrane due to the combination of the MD and TD spinnerets sets. In summary, electrospinning device according to the present invention has significant practical application value.

BRIEF DESCRIPTION OF THE ACCOMPANYING DRAWINGS

| Parts list | |
|---|---|
| 1. Global control unit; | 2. High-voltage DC power supply; |
| 3. Precision feeding pump; | 4. Lift platform; |
| 5. MD spinnerets set; | 6. TD spinnerets set; |
| 7. Main driving roller; | 8. Heating support roller; |
| 9. Stainless steel conveyor belt; | 10. Thickness control device; |
| 11. Molding roller; | 12. Electrostatic eliminator; |
| 13. Membrane collecting roller; | 14. Air compressor; |
| 15. Temperature control device; | 16. Ventilation device. |

EMBODIMENTS

The embodiments for carrying out the present invention will be described hereinafter with reference to the accompanying drawings. One skilled in the art would be appreciated that the embodiments described here are illustrative instead of limitation, and could make modifications or variations within the spirit and the scope of the present invention after reading the description. The protection scope of the present invention is defined by the appended claims.

Embodiment 1

Figure 1:
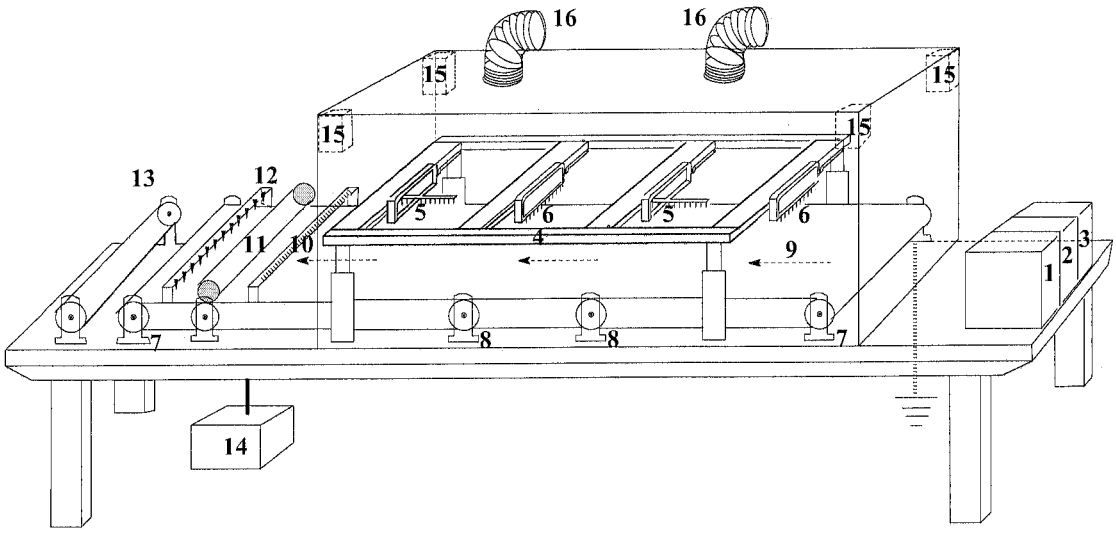
FIG. 1 is a schematic diagram of the electrospinning device for fabricating membrane according to the present invention.
Figure 2A:
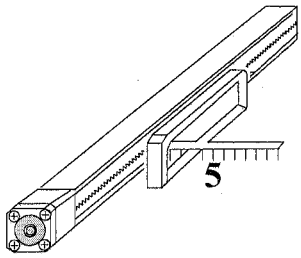
FIG. 2A is a schematic diagram of the MD spinnerets set according to the present invention.
Figure 2B:
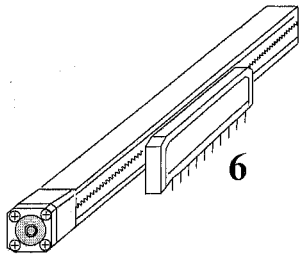
FIG. 2B is a schematic diagram of the TD spinnerets set according to the present invention.

Fabrication of a Single-Layer Water-Soluble PVA/$Al_2O_3$ Composite Nanofiber Membrane Reference is made to FIG. 1, FIG. 2A and FIG. 2B. The electrospinning device for fabricating membrane comprises a control section including at least a global control unit 1, a high-voltage DC power supply 2 and a precision feeding pump 3, a section for electrospinning nanofibre membrane including at least a lift platform 4, a MD spinnerets set 5, a TD spinnerets set 6, a first main driving roller 7, a second main driving roller 7, at least one heating support roller 8, a stainless steel conveyor belt 9 and linear motion guides, and an ancillary section including at least a thickness-control device 10, a molding roller 11, an electrostatic eliminator 12, a membrane collecting roller 13, an air compressor 14, temperature control devices 15 and a ventilation device 16.

The first main driving roller 7 and the second main driving roller 7 are mounted on a working platform with the distance therebetween being, for example, 2 meters. The stainless steel conveyor belt 9 is amounted on and run circularly around the first main driving roller 7 and the second main driving roller 7, and is grounded via special wires. Between the first main driving roller 7 and the second main driving roller 7, two, for example, heating support rollers 8, are amounted between the upper portion and the lower portion of the stainless steel conveyor belt running circularly around the first and second main driving rollers 7, and the distance between the two heating support rollers is for example about 60 cm. The global control unit 1, the high-voltage DC power supply 2 and the precision feeding pump 3 are mounted on the portion of the working platform that is outside of the space between the first and the second main driving rollers and near the first main driving roller. The membrane collecting roller 13 is mounted on the portion of the working platform that is outside of the space between the first and the second main driving rollers and near the second main driving roller.

The lift platform 4 is provided with a vertical positioning system and mounted above the stainless steel conveyor belt. The height of the lift platform 4 can be adjusted by the motor connecting to the vertical positioning system. Near the first main driving roller 7, two, for example, beams are mounted on the lift platform 4 across the width of the stainless steel conveyor belt, and the distance between the two beams is for example about 60 cm. Each beam has a respective linear motion guide mounted thereon which is provided with a slider and driven by a stepper motor or servo motor. The MD spinnerets set 5 as shown in FIG. 2A and the TD spinnerets set 6 as shown in FIG. 2B are respectively mounted on a respective one of the sliders of the linear motion guides near the first main drive roller 7.

Each of the MD and TD spinnerets sets consists of 8, for example, spinnerets aligned in an array. In each of the MD and TD spinnerets sets, the spinnerets are numbered 1, 2, 3, 4, 5, 6, 7 and 8 sequentially from the leftmost to the rightmost, and the distances between neighbor spinnerets can be set non-uniform, for example, being about 1.8 cm, about 2.0 cm, about 2.8 cm, about 4.5 cm, about 2.8 cm, about 2.0 cm and about 1.8 cm in sequence. The diameter of the pinhole of a spinneret is for example about 1.0 mm, and the length of a spinneret is about 20 mm.

The lift platform 4, the portions of the stainless steel convey belt that are below the lift platform and that are between the lift platform and the first main driving roller 7, and the first main driving roller 7 itself are covered by an isolation hood. The temperature control devices 15 are each mounted at a respective one of four upper corners of the isolation hood, and the ventilation device is mounted on the top of the isolation hood. Outside the isolation hood, in the direction from the lift platform 4 to the second main driving roller 7, the thickness-control device 10, the molding roller 11 and the electrostatic eliminator 12 are mounted above the stainless steel conveyor belt in this order and spaced apart.

The first main driving roller 7 or the second main driving roller 7, the molding roller 11, the membrane collecting roller 13 are each connected to its respective driving motor of which the rotations are synchronized.

The first main driving roller is equipped with a position adjusting cylinder and/or the second main driving roller is equipped with a position adjusting cylinder, the molding roller is equipped with a pressure adjusting cylinder, and all of the cylinders are connected to the air compressor 14 through pipes.

The precision feeding pump 3, a control motor of the lift platform 4, the stepper motor or servo motor of the MD spinnerets set 5, the stepper motor or servo motor of the TD spinnerets set 6, a heating device of the heating support roller 8, a control circuit of the thickness-control device 10, a driving motor of the molding roller 11, a driving motor of the membrane collecting roller 13, a switch circuit of the electrostatic eliminator 12, a switch circuit of the air compressor 14, a control circuit of the temperature control devices 15 and a switch circuit of the ventilation device 16 are all connected to the control circuit of the global control unit 1.

The precision feeding pump 3 is connected to the MD spinnerets set 5 and the TD spinnerets set 6 respectively through pipes.

The high-voltage DC power supply provides a positive or negative high-voltage to a metal part of each of the MD and TD spinnerets set via wires, and the stainless steel conveyor belt is grounded via specific wires.

The method for fabricating a polymer nanofiber membrane using the electrospinning device comprises the steps of:

(1) preparing an electrospinning solution, wherein a PVA (molecular weight, 77,000) is stirred into water at 90° C. for 2 hours and a transparent PVA aqueous solution is obtained with the concentration of PVA being 8 wt %;

a surfactant Triton X-100 is added into the PVA aqueous solution and the concentration of Triton X-100 therein is made to be 1 wt %;

the obtained solution is stirred at room temperature for 24 hours, and then nano $Al_2O_3$ with average diameter of for example 58 nm is added thereinto so that the concentration of the nano $Al_2O_3$ being 3 wt % of the obtained solution; and the obtained solution is continuously stirred at room temperature for 12 hours, treated with supersonic wave for 1 hour, and then the viscosity is tested to be about 700 mPa·S;

(2) using the electrospinning device for fabricating membrane in accordance with the present invention that comprises a MD spinnerets set and a TD spinnerets set, wherein the distance between the MD and TD spinnerets sets and the collecting plane of stainless steel conveyor belt is adjusted to be about 10 cm;

the voltage output from high-voltage DC power supply is 22 kV;

the MD and TD spinnerets sets are each driven by its respective driving motor to move in a to-and-fro scanning manner in the direction perpendicular to the moving direction of the stainless steel conveyor belt, with the scanning speeds of the MD and TD spinnerets sets being 150 cm/min and 60 cm/min respectively;

the scanning amplitude of the MD spinnerets set that is the width of the formed membrane is set to be 600 mm;

the stainless steel conveyor belt is driven by the first and the second main driving rollers to move at a speed of about 45 cm/min, for example;

the flow rate of the electrospinning solution supplied by the precision feeding pump to each spinneret in the MD and TD spinnerets sets is for example 10 mL/h;

the stainless steel sheet on stainless steel conveyor belt is heated by the heating support rollers to be at a temperature of about 40° C.;

the temperature of the electrospinning region is controlled by the temperature control devices to be about 40° C.;

the thickness of the PVA nanofiber membrane to be formed is set by the thickness control device; and the molding temperature for the formed PVA nanofiber membrane is set by the molding rollers;

(3) switching on the high-voltage DC power supply, the driving motor of the first or the second main driving roller, the stepper motors or servo motors driving the precision linear motion guides connected to the MD and TD spinnerets sets, the precision feeding pump, and supplying the electrospinning solution prepared in the step (1) to the MD and TD spinnerets sets in the order from the distance to the near to the collecting roller and distributing the same by a dispenser to each spinneret to jet, wherein the electrospinning solution jetted from the spinnerets is polarized at the tip of the spinnerets and split into nanoflows with a certain orientation under the action of a strong electric field between the MD and TD spinnerets sets and the stainless steel conveyor belt; and water volatilizes in the process of electrospinning and a PVA nanofiber membrane with high strength and high porosity is gradually formed on the surface of the stainless steel conveyor belt.

(4) carrying the PVA/$Al_2O_3$ nanofiber membrane formed in the step (3) by the stainless steel conveyor belt to the thickness control device to measure the thickness thereof, keeping the stainless steel conveyor belt moving circularly and continuing the electrospinning if the thickness doesn't meet a preset value, and carrying the PVA nanofiber membrane sequentially to the molding roller for molding process, to the electrostatic eliminator for electrostatic eliminating, and to the membrane collecting roller where the polymer nanofiber membrane is for example manually separated from the stainless steel conveyor belt and then collected if the thickness meets the preset value.

Figure 3:
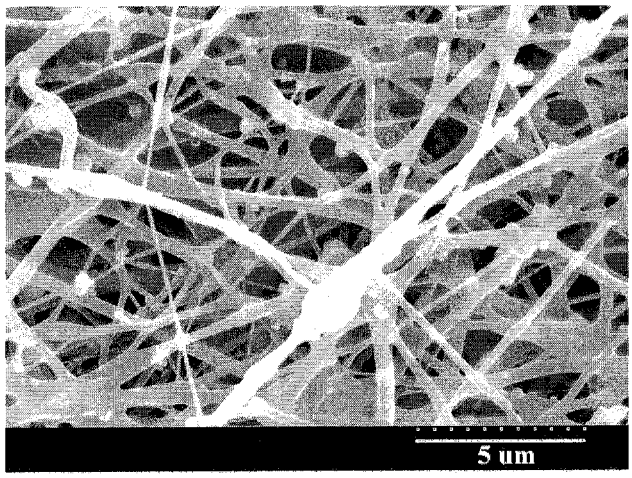
FIG. 3 is a scanning electron microscopy (SEM) image of the topography of a single-layer nanofiber membrane formed from the PVA/$Al_2O_3$ composite according to embodiment 1 of the present invention.

The color of the obtained PVA/$Al_2O_3$ nanofiber membrane is white, and the SEM image of FIG. 3 shows the topography of the membrane. The tensile strength of the membrane is 4.6 MPa, and the porosity thereof is about 60%. After cutting two edges of the membrane at 1.5 cm, the thickness of the remaining membrane is 40±2 μm.

Embodiment 2

Fabrication of a PVDF/PVDF-HFP Composite Nanofiber Membrane

The structure of the electrospinning device for fabricating membrane is the same as that in embodiment 1 except that the number of the spinnerets sets is 4 instead of 2. Specifically, two MD spinnerets sets 5 and two TD spinnerets sets 6 are alternately mounted with uniform spacing. In other words, one MD spinnerets set 5, one TD spinnerets set 6, one MD spinnerets set 5 and one TD spinnerets set 6 are arranged in this order. The MD and TD spinnerets sets are all same as those in embodiment 1. Each spinnerets set consists of 8 single spinnerets in a linear array, with the distances between neighbor spinnerets, the diameter of the pinhole of a single spinneret, and the length of a single spinneret being all the same as those in embodiment 1.

In order to further improve the evenness of the formed membrane, the flow rate of the solution fed to each spinneret in the MD or TD spinnerets set can be adjusted by its respective flow-limiting valve. For example, if the spinnerets in each of the MD and TD spinnerets sets are numbered 1, 2, 3, 4, 5, 6, 7, 8 sequentially from the leftmost to the rightmost, the flow-limiting valves for the spinnerets in either of MD and TD spinnerets sets that have a same number are set to provide the solution at a same flow rate.

The steps of the method for fabricating a polymer nanofiber membrane using the electrospinning device are the same as those in embodiment 1, except that the electrospinning solution is 10% (w/w) PVDF solution and 10%(w/w) PVDF-HFP solution. The PVDF solution was prepared by stirring PVDF having a molecular weight of about 700,000 in a solvent of dimethyl formamide (DMF)/Acetone (volume ratio: 8/2) at room temperature for 72 hours and getting a transparent solution of which the viscosity is about 700 mPa·S. The PVDF-HFP solution was prepared by stirring PVDF-HFP having a molecular weight of 470,000 in a same solvent of DMF/Acetone at room temperature for 72 hours and getting a transparent solution of which the viscosity is about 900 mPa·S.

The PVDF solution is supplied from a precision feeding pump to each MD spinnerets set at a same flow rate, and the PVDF-HFP solution is supplied from another precision feeding pump to each TD spinnerets set at a same flow rate.

The electrospinning device works at such conditions that: the scanning speed of the MD spinnerets sets is 940 mm/min; the scanning speed of the TD spinnerets sets is 600 mm/min; the scanning amplitude of the MD spinnerets sets that is also the width of the formed membrane is 1000 mm; the moving speed of stainless steel conveyor belt is 300 mm/min; the electrospinning solution is supplied to each of the MD and TD spinnerets sets at a flow rate of 16 mL/h; each of the flow-limiting valves for the spinnerets numbered 1, 2, 3, 6, 7 and 8 is completely open, i.e., the electrospinning solution is allowed to pass through the valves 100%; each of the flow-limiting valves for the spinnerets numbered 4 and 5 is open by 4/5, i.e. the electrospinning solution is allowed to pass through the valves in a ration of 80%; the distance between the MD and TD spinnerets sets and stainless steel conveyor belt is set as 120 mm; the MD spinnerets sets are supplied with PVDF-HFP solution and applied a voltage of 12 kV; the TD spinnerets sets are supplied with PVDF solution and applied a voltage of 16 kV; the temperature of the electrospinning region is set as 40° C.; and the molding in the post-process is performed at a temperature of 100° C.

Figure 4:
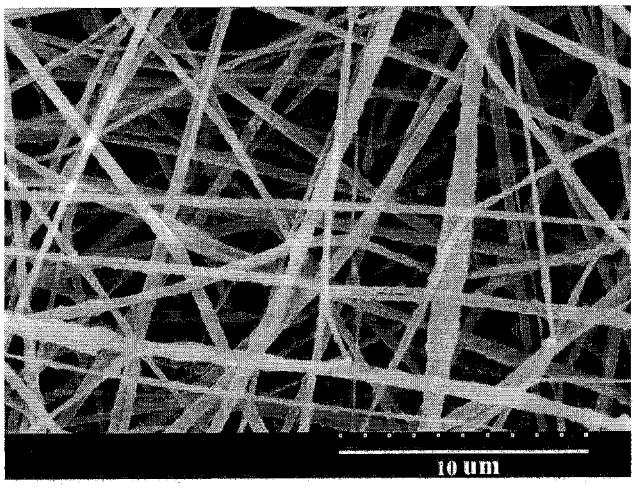
FIG. 4 is a SEM image of the topography of a multilayer composite nanofiber membrane formed from PVDF/PVDF-HFP according to embodiment 2 of the present invention.

The color of the formed PVDF/PVDF-HFP nanofiber composite membrane is white, and the SEM image of FIG. 4 shows the topography of the membrane. The tensile strength, the elongation at break and the porosity of the membrane is 28.8 MPa, >300% and about 70% respectively. After cutting two edges of the membrane at 1.5 cm, the thickness of the remaining membrane is 42+1 μm.

Embodiment 3

Fabrication of a PMMA/PVDF Nanofiber Composite Membrane

The structure of the electrospinning device for fabricating membrane is the same as that in embodiment 1, except that the distance between the two main drive rollers 7 is 10 meters instead of 2 meters and the number of the spinnerets sets is 16 instead of 2, the number of either of the MD and TD spinnerets sets being 8. The MD spinnerets sets and the TD spinnerets sets are alternately mounted with a constant distance of 60 cm therebetween.

Each of the MD and TD spinnerets sets in this embodiment consists of 10 spinnerets. The diameter of the pinhole of and the length of a single spinneret are about 1.0 mm and about 20 mm respectively. The spinnerets in each of the MD and TD spinnerets sets are numbered 1, 2, 3, 4, 5, 6, 7, 8, 9 and 10 sequentially from the leftmost to the rightmost. From the spinneret numbered 1 to that numbered 10, the distances between neighbor spinnerets are set as for example about 1.8 cm, about 2.0 cm, about 2.8 cm, about 4.5 cm, about 6.0 cm, about 4.5 cm, about 2.8 cm, about 2.0 cm, and about 1.8 cm.

The steps of the method for fabricating a polymer nanofiber membrane using the electrospinning device are the same as those in embodiment 1, except that a 10% (w/w) PVDF solution and a 10% (w/w) polymethylmethacrylate (PMMA solution were prepared. The PVDF solution was prepared by stiffing PVDF having a molecular weight of about 700,000 in a solvent of DMF/Acetone (volume ratio: 8/2) at room temperature for 72 hours and the viscosity of the obtained solution is about 700 mPa·S. The PMMA solution was prepared by stirring PMMA in a solvent of DMF/Acetone at room temperature for 72 hours and the viscosity of the obtained solution is about 300 mPa·S.

The flow-limiting valves for the spinnerets in either of MD and TD spinnerets sets that have a same number are set to provide the solution at a same flow rate. The PVDF solution is supplied from a precision feeding pump to each MD spinnerets set at a same flow rate, and the PMMA solution is supplied from another precision feeding pump to each TD spinnerets set at a same flow rate.

The electrospinning device works at such conditions that: the scanning speed of the MD spinnerets sets is 1500 mm/min; the scanning speed of the TD spinnerets sets is 660 mm/min; the scanning amplitude of the MD spinnerets sets that is also the width of the formed membrane is 800 min; the moving speed of stainless steel conveyor belt is 480 mm/min; the distance between the MD and TD spinnerets sets and stainless steel conveyor belt is set as 120 mm; the MD spinnerets sets are supplied with the PVDF solution at a flow rate of 60 mL/h/MD spinnerets set and applied a voltage of 12 kV; the TD spinnerets sets are supplied with the PMMA solution at a flow rate of 20 mL/h/TD spinnerets set and applied a voltage of 16 kV; each of the flow-limiting valves for the spinnerets numbered 1, 2, 3, 8, 9 and 10 is completely open, i.e., the electrospinning solution is allowed to pass through the valves 100%; each of the flow-limiting valves for the spinnerets numbered 4 and 7 is open by 9/10, i.e. the electrospinning solution is allowed to pass through the valves in a ration of 90%; each of the flow-limiting valves for the spinnerets numbered 5 and 6 is open by 4/5, i.e. the electrospinning solution is allowed to pass through the valves in a ration of 80%; and the temperature of the electrospinning region is set as 40° C.

Figure 5:
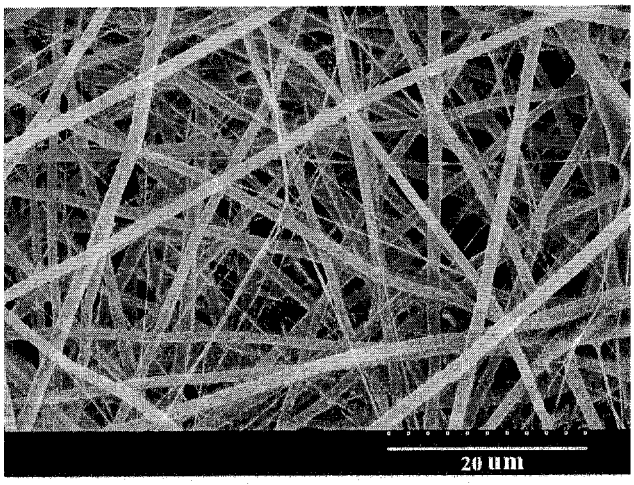
FIG. 5 is a SEM image of the topography of a multilayer composite nanofiber membrane formed from PMMA/PVDF according to embodiment 3 of the present invention.

The TD spinnerets set furthest from the collecting roller 13 (referred to as the furthest TD spinnerets set hereinafter for simplicity) is switched on firstly. If the portion of the stainless steel conveyer belt vertically below the furthest spinnerets set is referred to as the initial portion of the conveyer belt, the MD spinnerets set neighboring the furthest TD spinnerets set will not start to jet until the initial portion moves to the position vertically below it. When the initial portion of the conveyer belt lefts the position vertically below the spinnerets set nearest to the collecting roller 13, the thickness of the membrane reaches a preset value, and then molding process is performed by the molding roller at a temperature of 120° C. The membrane is cut before arriving at the collecting roller 13 and then be collected by it continuously. The color of the formed PVDF/PMMA composite nanofiber membrane is white, and the SEM image of FIG. 5 shows the topography of the membrane of which the porosity is 70% and the thickness is 30±1 μm.

The invention claimed is:

1. An electrospinning device for fabricating a membrane by using spinnerets aligned in machine direction (MD) and transverse direction (TD) comprising a section for electrospinning nanofiber membrane, an ancillary section and a control section for controlling the operation of both the section for electrospinning nanofiber membrane and the ancillary section, characterized in that the section for electrospinning nanofiber membrane comprises a stainless steel conveyor belt, at least one MD spinnerets set mounted above the stainless conveyor belt with the spinnerets aligning in the MD, and at least one TD spinnerets set mounted above the stainless conveyor belt with the spinnerets aligning in the TD, the MD and TD spinnerets sets moving in a to-and-fro scanning manner transverse to the moving direction of the stainless steel conveyor belt, the electrospinning direction of the MD and TD spinnerets sets being perpendicular to a surface of the stainless steel conveyor belt, and a high voltage electrostatic field being applied between the MD and TD spinnerets sets and the stainless steel conveyor belt.

2. The electrospinning device according to claim 1, further comprising a working platform, first and second separated main driving rollers mounted on the working platform, and at least one heating support roller, wherein the stainless steel conveyor belt is mounted on and runs circularly around the first and second main driving rollers and is grounded, and the at least one heating support roller is mounted between the first and second main driving rollers and between an upper portion and a lower portion of the stainless steel conveyor belt running circularly around the first and second main driving rollers.

3. The electrospinning device according to claim 2, further comprising a lift platform that is fixed on the working platform above the stainless steel conveyor belt, and at least two beams mounted on the lift platform across the width of the stainless steel conveyor belt, each of the beams having a linear motion guide with a slider driven by a stepper motor or servo motor mounted thereon, wherein each of the sliders has the MD or TD spinnerets set mounted thereon;

when the at least two beams comprise two beams, one of the beams has the MD spinnerets set mounted on the slider thereon and the other one of the beams has the TD spinnerets set mounted on the slider thereon; and when the at least two beams comprise more than two beams, the MD spinnerets sets and the TD spinnerets sets are alternately mounted on the beams that are equally spaced.

4. The electrospinning device according to claim 3, wherein the ancillary section comprises a thickness-control device, a molding roller, an electrostatic eliminator, a membrane collecting roller, an air compressor, temperature control devices and a ventilation device;

the lift platform, the portions of the stainless steel conveyor belt that are below the lift platform and that are between the lift platform and the first main driving roller, and the first main driving roller itself are covered by an isolation hood;

the temperature control devices are each mounted at a respective one of four upper corners of the isolation hood, and the ventilation device is mounted on the top of the isolation hood;

the thickness-control device, the molding roller, and the electrostatic eliminator are mounted above the portion of the stainless steel conveyor belt between the lift platform and the second main driving roller outside of the isolation hood in this order in the direction from the lift platform to the second main driving roller and spaced apart;

the membrane collecting roller is mounted on the portion of the working platform that is outside of a space between the first and the second main driving rollers and near the second main driving roller;

the first or second main driving roller, the molding roller, and the collecting roller are each connected to a respective driving motor of which the rotations are synchronized; and the first main driving roller is equipped with a position adjusting cylinder and/or the second main driving roller is equipped with a position adjusting cylinder, and the molding roller is equipped with a pressure adjusting cylinder, all of the cylinders being connected to the air compressor through pipes.

5. The electrospinning device according to claim 4, wherein the control section comprises a global control unit, a high voltage DC power supply and at least one precision feeding pump.

6. The electrospinning device according to claim 5, wherein the at least one precision feeding pump, a control motor of the lift platform, the stepper motor or servo motor for the MD spinnerets set, the stepper motor or servo motor for the TD spinnerets set, a heating device of the heating support roller, a control circuit of the thickness-control device, the driving motor of the molding roller, a driving motor of the membrane collecting roller, a switch circuit of the electrostatic eliminator, a switch circuit of the air compressor, a control circuit of the temperature control devices and a switch circuit of the ventilation device are all connected to a control circuit of the global control unit.

7. The electrospinning device according to claim 5, wherein the MD and TD spinnerets sets are respectively connected to the at least one precision feeding pump via pipes.

8. The electrospinning device according to claim 5, wherein the high voltage DC power supply is connected to a metal part of each of the MD spinnerets set and TD spinnerets set via wires to provide a positive or negative high voltage thereto; and the stainless steel conveyor belt is grounded via specific wires.

9. The electrospinning device according to claim 3, wherein the lift platform is equipped with a height-adjustable vertical positioning system, and the height of the lift platform can be adjusted by a motor connected to the vertical positioning system.

10. The electrospinning device according to claim 2, wherein the at least one heating support roller comprises more than one heating support rollers mounted at an interval of about 60 cm.

11. The electrospinning device according to claim 1, wherein each of the MD and TD spinnerets sets consists of a linear array of spinnerets and the distances between neighbor spinnerets are in the range of 18-60 mm.

12. The electrospinning device according to claim 11, wherein the distances between neighbor spinnerets in each of the MD and TD spinnerets sets are non-uniform.

13. The electrospinning device according to claim 11, wherein the number of the spinnerets in each of the MD and TD spinnerets sets is in the range of 8-20;

the diameter of the pinhole of a single spinneret is in the range of 0.8-1.6 mm; and the length of a single spinneret is in the range of 10-30 mm.

14. A method for fabricating a polymer nanofiber membrane by using the electrospinning device according to claim 1, comprising:

(1) preparing a polymer electrospinning solution by using a solvent and adjusting the viscosity of the polymer electrospinning solution to be in the range of 300-1000 mPa·S by adjusting the concentration of the polymer in the polymer electrospinning solution;

(2) adjusting the distance between the MD and TD spinnerets sets and a collecting plane of the stainless steel conveyor belt to be in the range of 5-15 cm, setting the output voltage from a high voltage power supply in the range of 5-25 kV, moving the MD and TD spinnerets sets in a to-and-fro scanning manner perpendicular to the moving direction of the stainless steel conveyor belt, setting the scanning speeds of the MD and TD spinnerets sets to be in the range of 90-360 cm/min and 30-120 cm/min respectively, setting the moving speed of the stainless steel conveyor belt driven by a first and a second main driving rollers to be in the range of 15-240 cm/min, setting the flow rate of the polymer solution fed into each spinneret of both the MD and TD spinnerets sets from a precision feeding pump to be in the range of 1-20 mL/hour; heating the stainless steel conveyor belt by a heating support roller so that the temperature thereof is in the range of 30-40° C., controlling the temperature of the electrospinning section to be between 30° C. and 60° C. by temperature control devices, setting the thickness of the polymer nanofiber membrane to be formed by a thickness control device, and setting the molding temperature by a molding roller;

(3) switching on a high-voltage DC power supply, driving motors of the first or the second main driving roller, stepper motors or servo motors for precision linear motion guides that are connected to the MD and TD spinnerets sets, and the precision feeding pump, and supplying the polymer electrospinning solution prepared at the step 1 to each of the MD and TD spinnerets sets to jet in the order from the distance to the near to the collecting roller, wherein the portion of the stainless steel conveyor belt vertically below the spinnerets set furthest from the collecting roller is referred to as the initial portion of the conveyor belt, and a spinnerets set will not start to jet until the initial portion moves to the position vertically below the respective spinnerets set; and the polymer electrospinning solution is dispensed by a dispenser to each spinneret, immediately polarized at a tip of the spinneret, split into nanoflows under the action of an electric field force, and accumulates on the surface of the stainless steel conveyor belt so as to form a polymer nanofiber membrane;

(4) carrying the polymer nanofiber membrane formed in the step 3 by the stainless steel conveyor belt to the thickness control device to measure the thickness thereof, keeping the stainless steel conveyor belt moving circularly and continuing the electrospinning of the polymer electrospinning solution if the thickness does not meet a preset value, and carrying the polymer nanofiber membrane to the molding roller for molding process, to a electrostatic eliminator for electrostatic eliminating, and to a membrane collecting roller where the polymer nanofiber membrane is separated from the stainless steel conveyor belt and then collected if the thickness meets the preset value.

15. The method according to claim 14, further comprising obtaining a single-layer polymer nanofiber membrane if the precision feeding pump connected to the MD spinnerets set and the precision feeding pump connected to the TD spinnerets set are provided with a same polymer composite solution, or obtaining a multilayer composite nanofiber membrane of multiple polymer composites if the precision feeding pump connected to the MD spinnerets set and the precision feeding pump connected to the TD spinnerets set are provided with different polymer composite solutions.

* * * * *